US005611123A

United States Patent [19]

Prizzi

[11] Patent Number: 5,611,123

[45] Date of Patent: Mar. 18, 1997

[54] TOWEL HOLDER

[76] Inventor: Darin Prizzi, 8416 Mantanzas Rd., Fort Myers, Fla. 33912

[21] Appl. No.: 491,820

[22] Filed: Jun. 19, 1995

[51] Int. Cl.[6] ..... A47H 13/00

[52] U.S. Cl. ..... 24/459; 297/220; 297/229; 24/336; 24/563; 24/72.5; 211/124; 248/316.5

[58] Field of Search ..... 24/459, 460, 487, 24/532, 545, 546, 549, 3.3, 67.3, 334, 327, 716, 30.5 S, 508, 30.5 P, 499, 500, 501, 509, 563, 462, 72.5; D6/522, 546, 547, 521, 326; 211/124, 45, 89; 248/467, 230.4, 231.51, 229.13, 316.5; 297/440.11, 228.11–228.13, 228.1, 218.3, 218.5, 188.04, 188.2, 220, 229, 219.1

[56] References Cited

U.S. PATENT DOCUMENTS

| | | | |
|---|---|---|---|
| D. 327,382 | 6/1992 | Cabler | D6/547 X |
| D. 363,016 | 10/1995 | Sipprelle, III et al. | 24/336 X |
| 563,121 | 6/1896 | Bartlett | 24/334 X |
| 1,179,073 | 4/1916 | Clements | 24/508 |
| 1,621,645 | 3/1927 | Thorp | 248/316.5 X |
| 2,596,635 | 5/1952 | Wolfe | 24/500 X |
| 3,423,775 | 1/1969 | Cockerill | 297/218.5 X |
| 3,606,228 | 9/1971 | Lasko | 211/89 X |
| 4,010,879 | 3/1977 | George et al. | 24/562 X |
| 4,395,799 | 8/1983 | Batts | D6/326 X |
| 4,934,540 | 6/1990 | Novak | 24/563 X |
| 4,993,126 | 2/1991 | Collins | 24/336 |
| 5,182,827 | 2/1993 | Carrier et al. | 24/72.5 X |
| 5,351,371 | 10/1994 | Deveau, Jr. et al. | 24/459 X |
| 5,363,538 | 11/1994 | Arrendiell et al. | 24/508 X |

*Primary Examiner*—Peter M. Cuomo
*Assistant Examiner*—Robert J. Sandy
*Attorney, Agent, or Firm*—William F. Hamrock

[57] ABSTRACT

The holder is a plastic tube split lengthwise into substantially mirror image halves forming two opposed clamping members hingedly connected by spring operated handles which activate opening and closing of the clamping members to engage a towel or other items hanging on a support.

7 Claims, 4 Drawing Sheets

TOWEL HOLDER

BACKGROUND OF THE INVENTION

1. Field of the Invention

The invention relates to a holder for towels, blankets or similar items and, in particular, to a plastic tube holder which maintains a towel or blanket securely attached to a chair, such as a beach chair, and prevents the towel or blanket from slipping down.

2. Description of the Prior Art

There is a problem in the prior art relative to holding devices which will securely hold an item to an object and will prevent the item from slipping down.

Experience has taught us that in the course of hanging or placing an item on an object, one is frequently faced with the problem of the item slipping down or falling off the object. Such is the situation when placing a towel or blanket on a beach chair or the like to shield one's body from the chair. The towel or blanket is constantly slipping down and defeating its purpose by allowing the body to be in contact with the chair. Similar situations exist when hanging or placing blankets, clothes, curtains, sheets of material or other hanging items on a support. Thus, there is a need of a simple device which will securely hold an item to an object.

Applicant is unaware of any simple holding device which will securely hold an item to an object such as a towel or blanket to a beach chair to prevent it from slipping down.

SUMMARY OF THE INVENTION

The general object of the invention is to provide a device which serves to provide a releasable holder which will securely clamp an item to an object.

It is another object of the invention to provide a releasable towel holder which will securely clamp the towel or blanket to the top of a chair, such as a beach chair, and prevent the towel from slipping down.

It is a further object of the invention to provide a releasable towel or blanket holder for a beach chair which is an attractive adjunct thereto, lending an air of smartness while providing a great convenience.

It is a further object of the invention to provide a releasable holder for securely clamping and hanging items to lines, rods or similar supports.

It is a further object of the invention to provide a releasable holder which is easy to operate.

It is a further object of the invention to provide a releasable holder for securely clamping items to an object which also can be attached to the object for safe-keeping or storage.

Other objects and advantages of the invention will be apparent from the following disclosure.

In accordance with the present invention, a holder is provided which is a unitary device having opposing movable parts. In operating the holder, the moveable parts are actuated to an open position so as to enclose and then clamp the holder to the object in the locked position. The improved holder has the advantage of being easily operated by pivotal handles conveniently positioned therein.

The holder includes a plastic tube having a bore extending therethrough. The plastic tube is split lengthwise into two substantially mirror images halves forming clamping members which are joined together along their adjacent split edges by at least one tensionally operated handle positioned on one side of the tube at the aligned split edges. The holder tube member split halves are actuated to the open and closed positions respectively by applying and releasing pressure to the handle or handles by means of one's fingers. When pressure is applied to the one side of the holder, the opposite side clamping members of the split tube open up allowing them to enclose the object. The holder will securely clamp a towel to the top of a beach chair allowing the towel to hang down without slipping off of the chair. In addition to its use as a towel holder, the unique holder has many other uses such as securing curtains, and various hanging objects or other materials to a support.

BRIEF DESCRIPTION OF THE DRAWINGS

A better understanding of the present invention will be had upon reference to the following detailed description when read in conjunction with the accompanying drawings, wherein like reference characters refer to like parts through out the several views, and in which.

DETAILED DESCRIPTION

Figure 1:
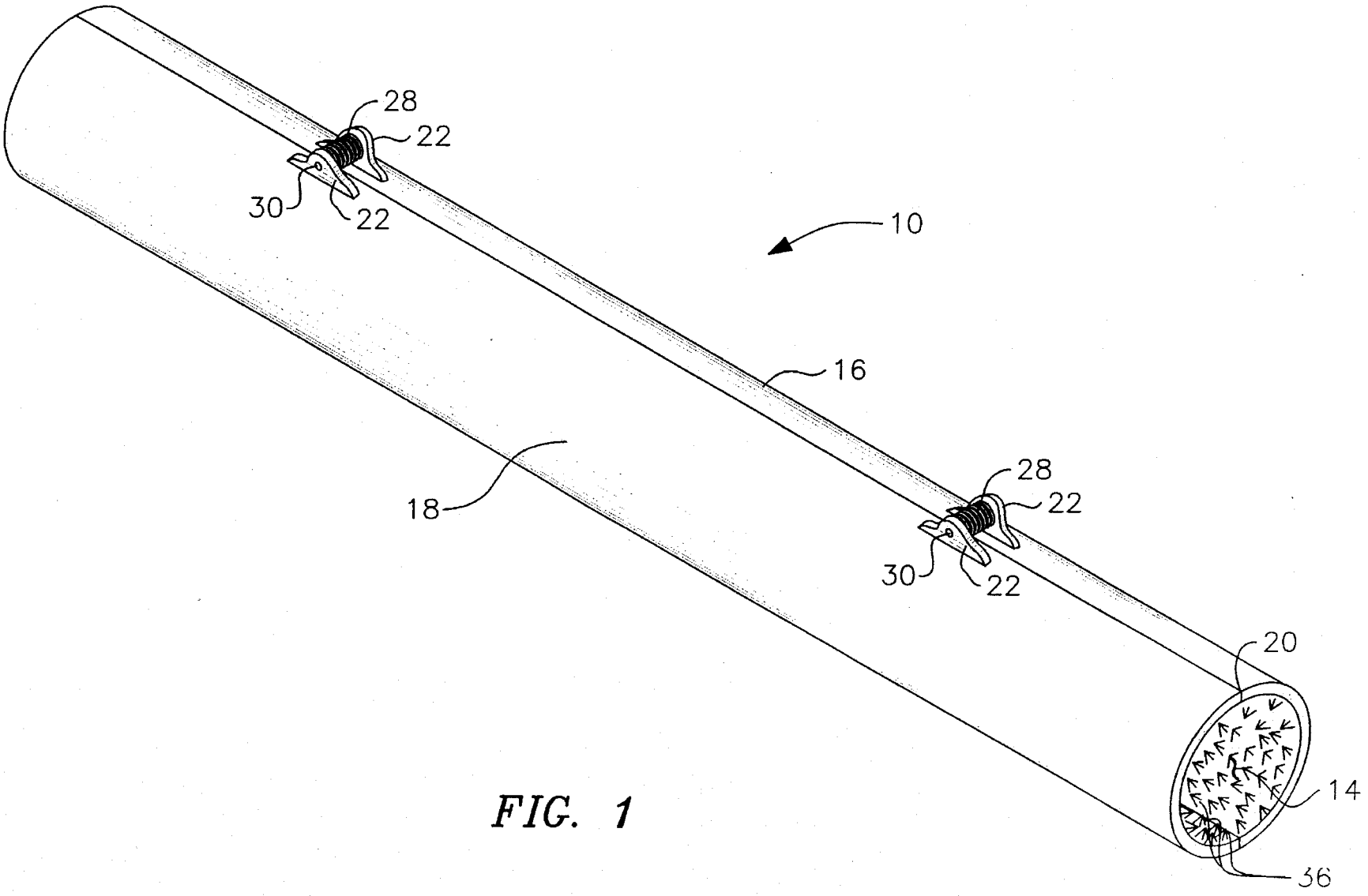
FIG. 1 is a perspective view of the unique holder of the invention with the tube clamping members in the closed inactivated position.

The unique holder disclosed herein is not merely a complicated holder or clamp which is difficult to operate and must be stored away when not in use and performs only a single function such as holding a towel. To the contrary, the unique holder of the present invention is a simple device which is relatively easy to operate. Because of its pleasing appearance and structure, it can also be attached to the object, such as a beach chair, for safekeeping when not in use as a holder thus adding a pleasant and unique feature to the object. Further, it is not limited to holding only one item but is capable of holding up various articles such as: towels, blankets, clothes, curtains, various sheets of material or other hanging items to support.

Referring to FIGS. 1 to 5, holder 10 which is constructed in accordance with the invention includes plastic tube 12 having a bore 14 extending through its entire length. Plastic tube 12 is split lengthwise into two substantially mirror image halves forming top clamping member 16 and bottom clamping member 18 having adjacent split edges 20. At least one integrally attached opposing ledge handle member 22 having a curved surface extends outwardly from one side of each clamping member. Each ledge handle member 22 is spaced at intermediate positions on one side of each clamping member at the aligned split edges and has an opening 24 therethrough. Spring mechanism 26 which includes coil spring 28 and female rivets 30 is securely embedded within opposing handle ledge members 22 by each female rivet 30. The female rivet passes through opening 24 and locks onto coil end 32 of coil spring 28 to provide a pivotal handle 34 which actuates the opening and closing of clamping members 16 and 18. Clamping members 16 and 18 have serrated interior curved surfaces 36 in order that they will firmly grip hold onto the object therebetween.

Figure 2:
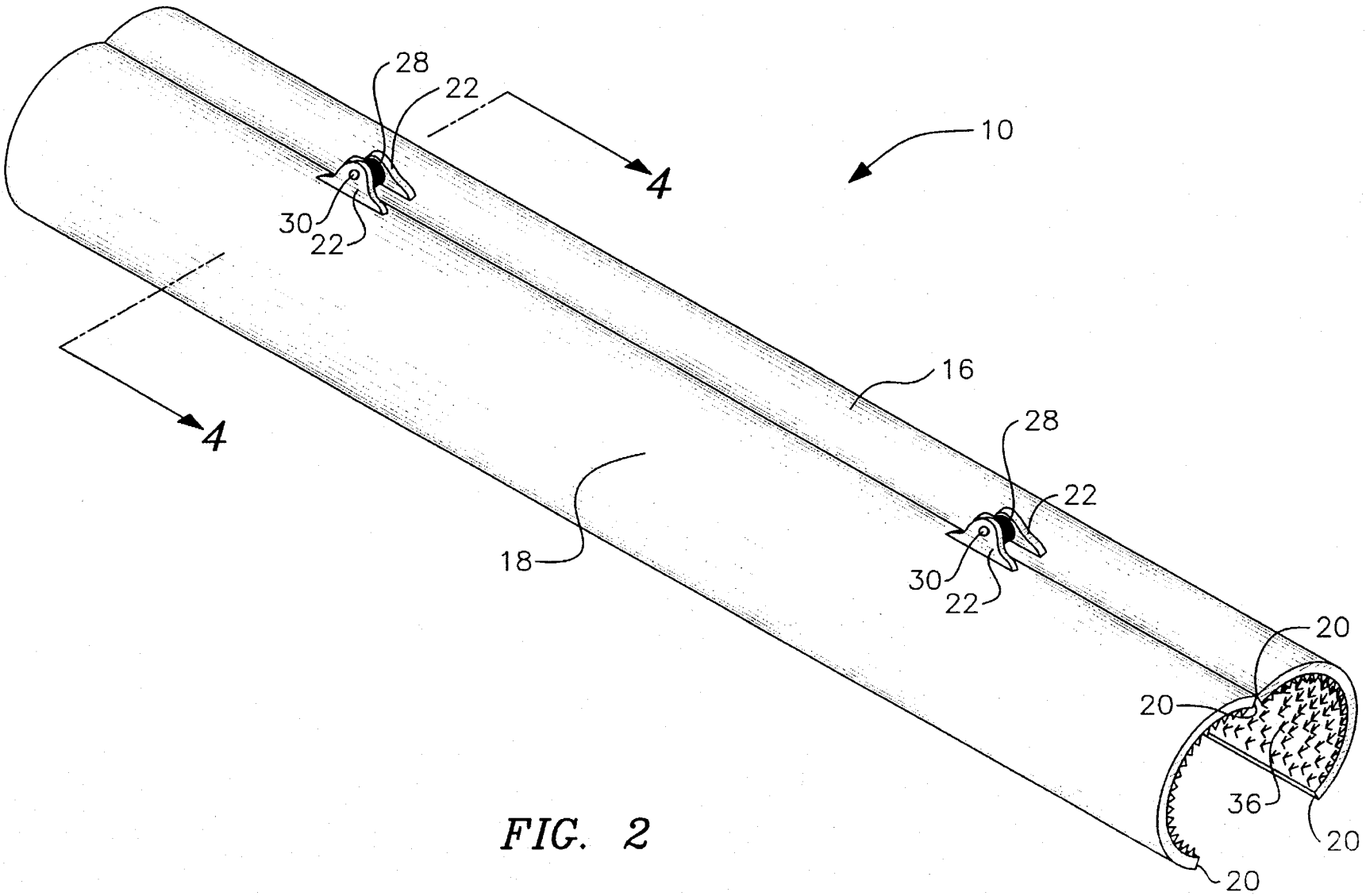
FIG. 2 is a perspective view of the holder of the invention in the activated open position.
Figure 3:
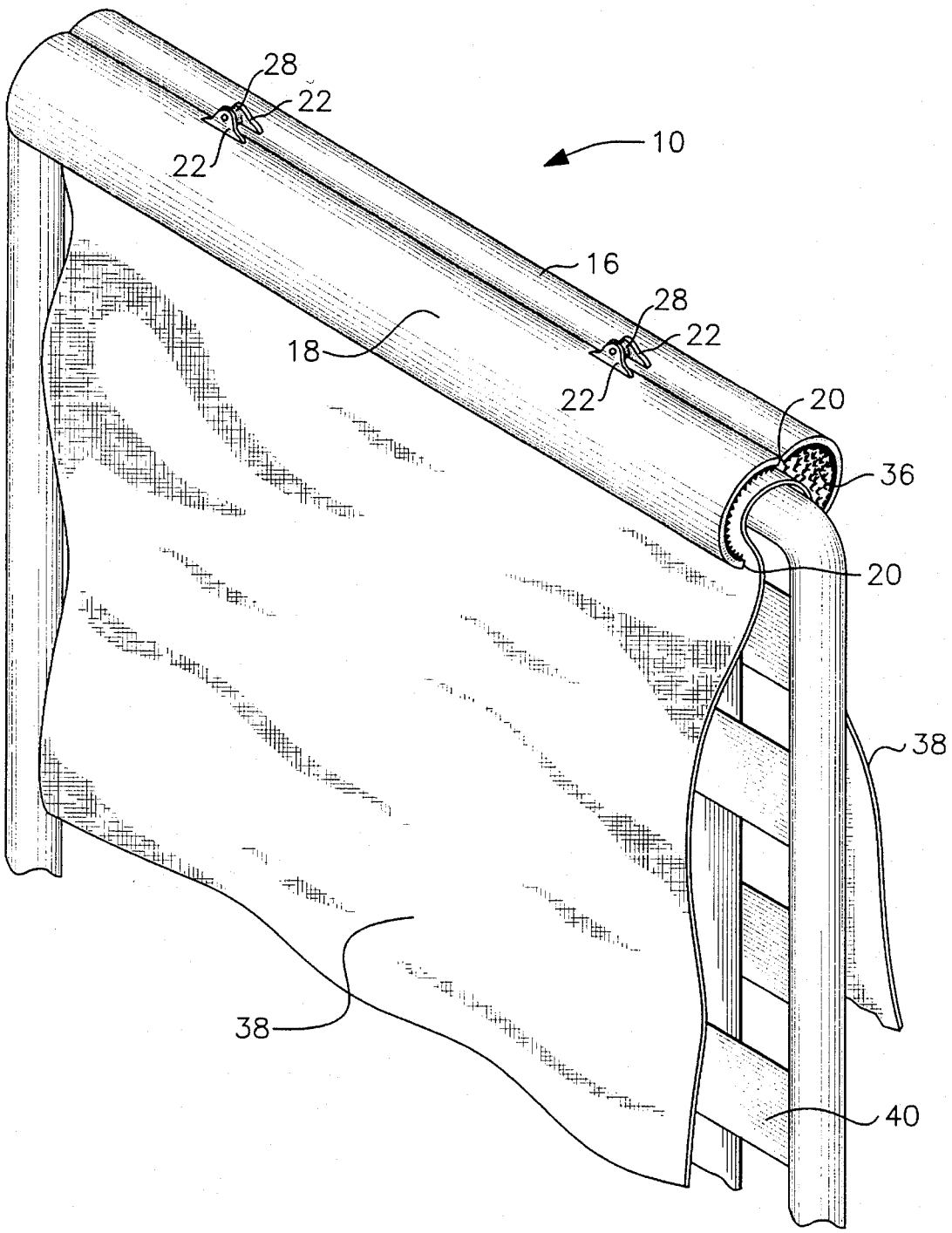
FIG. 3 is a perspective view of the holder of the invention in engagement with a towel and a beach chair.

When pivotal handles 34 are inactivated as shown in FIG. 1, the holder 10 is in the closed position with adjacent split edges 20 of top and bottom clamping members 16 and 18 coming together. When pressure is applied by one's fingers to ledge handle members 22 as seen in FIG. 2, the ledge handle members are forced towards each other overcoming the tension of spring mechanism 28. At this point, clamping members 16 and 18 are extended to their opened position whereby they can be placed over towel 38 and beach chair 40 as seen in FIG. 3. Upon removing of the fingers and pressure from handle ledge members 22, the tension of spring mechanism 28 then forces top and bottom clamping members 16 and 18 together in the closed position securing the towel to the chair.

Figure 4:
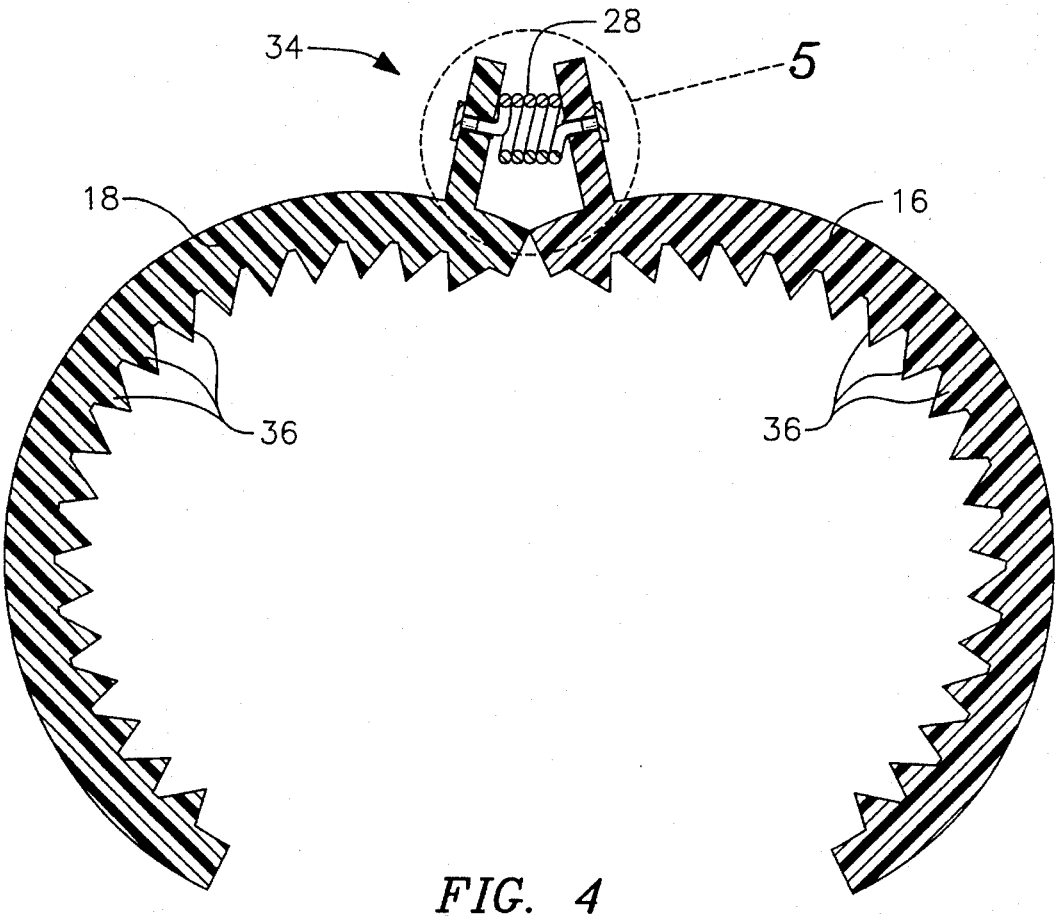
FIG. 4 is a sectional view of the attachment of the handle mechanism.
Figure 5:
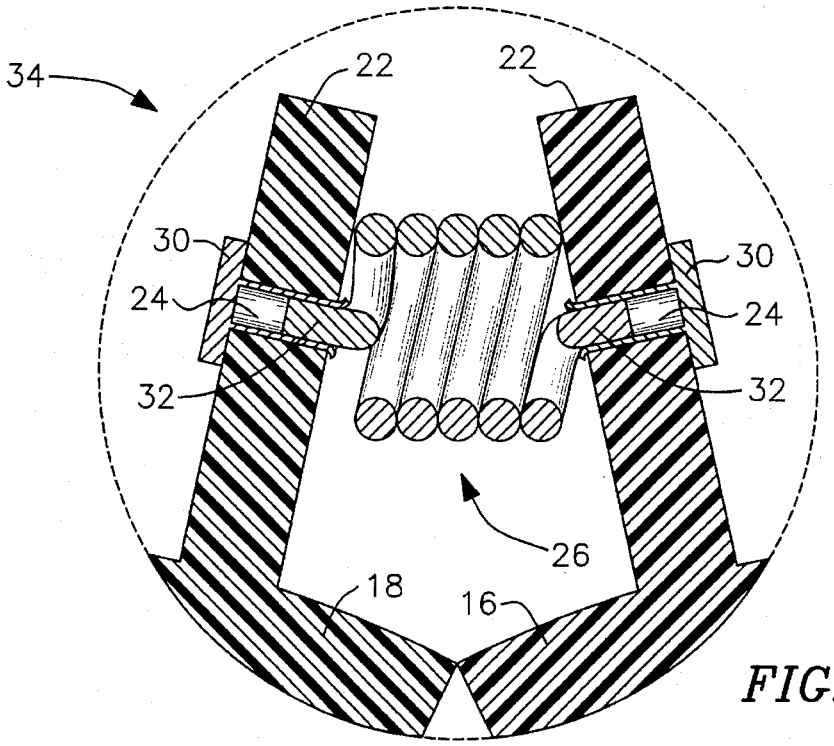
FIG. 5 is an enlarged sectional view of the handle mechanism.

Shown in FIGS. 4 and 5 are sectional views of spring mechanism 28 depicting how coil spring 28 is securely embedded within opposing ledge handle members 22. As seen therein, flat head rivet 30 passes through opening 24 of ledge handle member 22 and securely engages coil end 32 of the coil spring having the flat head of the rivet evenly seated within the opening. When finger pressure is applied to the opposing ledge handle member and rivet head to overcome the tension of the coil spring, opposing ledge handle members are forced together opening up clamping members 16 and 18 allowing the holder to be secured to an object. Although spring mechanism 26 employs female rivets 30 to secure coil spring 28 to the handle ledge members, other fastening means which secure the coil spring within the handle ledge members would be applicable.

Holder 10 is generally about 15 to 18 inches in length with an outside tube diameter of about one and three quarter inches more or less depending upon the size of the object to be enclosed and the tube about five thirty seconds of an inch thickness. The plastic tube may be made from polyvinylchloride or similar plastic material having a rigidity to meet the requirements for the particular holder. Serrated interior curved surfaces 32 project into the underlying surface and securely hold the clamped object in place.

Having now described the invention, it will be apparent to one of ordinary skill in the art that many changes and modifications can be made thereto without departing form the spirit and scope of the invention as set forth herein.

What is claimed is:

1. In combination a releasable tube holder and a longitudinal support comprising, said tubular holder having a circular plastic tube about 15 to 18 inches in length split lengthwise longitudinally into substantially mirror image straight halves forming two opposed clamping members joined together at straight across split edges, each clamping member provided with two separated handle members positioned on one side of the clamping member and opposite the other two separated handle members of the other clamping member, said oppositely positioned handle members being hingedly connected by tensioned metal spring mechanisms to activate opening and closing of the opposed clamping members and split edges which engage and are secured to the support by applying and removing pressure on the oppositely positioned handle members.

2. In combination a releasable tube holder and a longitudinal support comprising, said longitudinal support supporting a towel handing therefrom, said tubular holder having a circular plastic tube about 15 to 18 inches in length split lengthwise longitudinally into substantially mirror image straight halves forming two opposed clamping members joined together at straight across split edges, each clamping member provided with two separated handle members on one side of the clamping member and opposite the other two separated handle members of the other clamping member, said oppositely positioned handle members being hingedly connected by tensioned metal spring mechanisms to activate opening and closing of the opposed clamping members and split edges and secured the towel to the support by applying and removing pressure on the oppositely positioned handle members.

3. The holder according to claim 2 wherein said plastic tube has an interior surface which has been serrated.

4. The holder according to claim 2 wherein said plastic tube is prepared from polyvinylchloride.

5. The holder and support according to claim 2 wherein the support is a beach chair having a longitudinal top support.

6. The holder according to claim 2 wherein the tube is about five thirty seconds of an inch in thickness.

7. The holder according to claim 2 wherein the tube is a rigid plastic tube.

* * * * *